United States Patent [19]

Staats et al.

[11] Patent Number: 4,492,947

[45] Date of Patent: Jan. 8, 1985

[54] RESISTOR HAVING A POSITIVE TEMPERATURE COEFFICIENT

[75] Inventors: Jean B. C. H. Staats, Stadskanaal, Netherlands; Gabriël D. Declerck, Brussels, Belgium

[73] Assignee: U.S. Philips Corporation, New York, N.Y.

[21] Appl. No.: 389,187

[22] Filed: Jun. 17, 1982

[30] Foreign Application Priority Data

Jun. 29, 1981 [NL] Netherlands ..... 8103116

[51] Int. Cl.[3] ..... H01C 7/02

[52] U.S. Cl. ..... 338/22 R; 219/541; 338/322; 338/324; 338/273; 338/332

[58] Field of Search ..... 338/25, 22 R, 22 SD, 338/23, 24, 28, 323, 272, 324, 273, 328, 332, 320; 219/541; 374/185, 208

[56] References Cited

U.S. PATENT DOCUMENTS

| | | | |
|---|---|---|---|
| 2,462,369 | 2/1949 | Drake et al. | 338/22 R X |
| 2,880,295 | 3/1959 | Huffman | 338/22 R |
| 3,016,506 | 1/1962 | Rakowski et al. | 338/22 R |
| 3,794,949 | 2/1974 | Larsen et al. | 338/22 R |
| 3,868,620 | 2/1975 | McBride, Jr. et al. | 338/22 R |
| 3,955,170 | 5/1976 | Gershecker | 338/22 SD |
| 3,958,208 | 5/1976 | Blaha | 338/22 R |
| 3,996,447 | 12/1976 | Bouffard et al. | 338/22 R X |
| 4,099,154 | 7/1978 | Bar | 338/22 R X |
| 4,318,073 | 3/1982 | Rossler, Jr. et al. | 338/22 R |
| 4,325,051 | 4/1982 | Rodriguez | 338/22 SD X |

FOREIGN PATENT DOCUMENTS

| | | | |
|---|---|---|---|
| 1023500 | 3/1966 | United Kingdom | 338/22 SD |

*Primary Examiner*—C. L. Albritton

*Attorney, Agent, or Firm*—Norman N. Spain

[57] ABSTRACT

A resistor having a positive temperature coefficient in which a plate-shaped resistive element 1 is incorporated in a tubular envelope 2 between two electrical conductors 3, 4 which are in contact with the resistive element and which project from opposite ends 5, 6 of the envelope. The end face of at least one of the conductors 3 present inside the envelope has raised portions 10 against which the major surface of the plate-shaped resistive element facing said conductor 3 bears so as to obtain a poor thermal conductivity.

6 Claims, 5 Drawing Figures

RESISTOR HAVING A POSITIVE TEMPERATURE COEFFICIENT

The invention relates to a resistor having a positive temperature coefficient, in which a plate-shaped resistive element is incorporated in a generally tubular envelope between two electrical conductors which are in electrical contact with the resistive element and which project respectively from opposite ends of the envelope.

Resistors having a positive temperature coefficient may be used, for example, as current limiters, as temperature sensors, as level indicators, etc. The resistive elements are generally manufactured from $BaTiO_3$ or $SrTiO_3$.

In certain situations it is necessary for the time in which the resistance changes from a low value to a high value to be very short. This switching time must, for example in certain cases of current limiting in telephony applications, be less than 2 seconds and preferably less than 1 second. Such a short switching time cannot be reached with conventional resistors having a positive temperature coefficient.

It is the object of the invention to provide a resistor having a positive temperature coefficient with a very short switching time without requiring complicated and expensive constructions. In order to reach this object, according to the invention, at least one conductor present inside the envelope has an end face with raised portions against which a major surface of the plate-shaped resistive element facing said conductor bears.

The invention is based on the recognition of the fact that, in order to obtain a short switching time, measures have to be taken which impede the dissipation of thermal energy from the resistive element. This is achieved by purposely creating a thermal contact, which is as poor as possible, which, however, is very uncommon in electronic and electrical components. In the resistor according to the invention the thermal energy of the resistive element is dissipated via the electric conductors.

By means of the measure according to the invention it is achieved that the contact area between the conductor and the resistive element is small so that heat dissipation occurs in an inert manner. When an electric current passes through the resistive element it consequently obtains the temperature with which the high resistance value is associated in a very short period of time.

In a particularly favourable embodiment in accordance with the invention the raised portions are radial strips whose height increases gradually from the centre towards the edge of the end face of the conductor. The resistive element bears only against the highest portions of the strips. It has only a very small contact area so that heat dissipation through the electric conductor is extremely low and the switching time is very short.

In an embodiment in accordance with the invention the raised portions are provided on a flange present at the end face of the conductor. In that case the location of the raised portions is not restricted by the thickness of the conductor.

The raised portions may be provided on a metal plate having a relatively low thermal conductivity and connected to the end face of the conductor. As a result of this the thermal resistance is increased. In order to increase further the thermal resistance the material of the electric conductor may be an iron-nickel alloy.

In a further embodiment in accordance with the invention in which one of the electric conductors has a resilient band which presses against the major surface of the resistive element facing said conductor, the resilient band is preferably constructed in a width which is less than half the diameter of the plate-shaped resistive element. As a result of this it is also obtained that the contact area with the resistive element is as small as possible so that the measure is favourable to obtain a short switching time.

The invention will be described in greater detail with reference to embodiments shown in the drawing.

Figure 1:
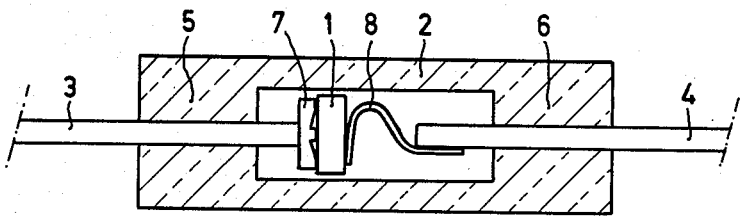
FIG. 1 is a sectional view of a resistor having a positive temperature coefficient according to the invention.
Figure 5:
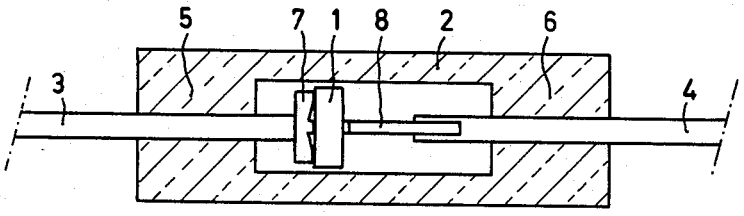
FIG. 5 is the same cross section as FIG. 1 but rotated over a quarter of a turn.

FIGS. 1 and 5 are sectional views of a resistor having a positive temperature coefficient. A disk-shaped resistive element 1 is incorporated in a generally tubular envelope 2, preferably of glass. Electric conductors 3 and 4 project respectively from opposite ends of the tubular envelope. The conductors are sealed in the tube at the ends 5 and 6. The conductor 3 has a flange 7. A band-shaped resilient element 8 of electrically conductive material is connected to conductor 4. The resilient element 8 presses the resistive element 1 against the flange 7.

The resistive element 1 has a resistance value which depends on the temperature. In the case of current passage through the resistor the temperature thereof increases; the resistance changes from a low value to a high value. The time for this change to take place must be very short in a number of applications. The invention is based on the recognition of the fact that a short switching time can be achieved when the thermal energy generated in the resistive element 1 during the passage of current is prevented from being dissipated very rapidly through the conductors 3, 4.

Figure 2:
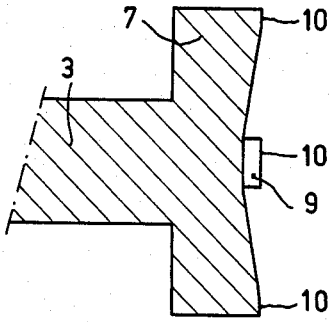
FIGS. 2 and 3 are a longitudinal sectional view and a front elevation respectively of one of the conductors on an enlarged scale.
Figure 3:
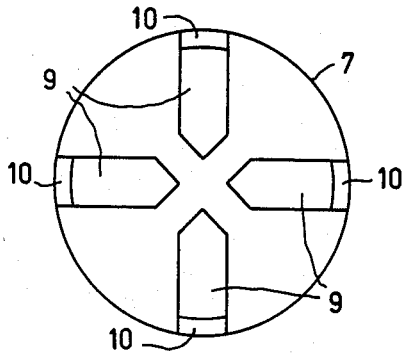

A low heat dissipation from the resistive element is obtained to a considerable extent when the contact area of the resistive element 1 and the conductor 3 is very small. For that purpose, raised portions against which the resistive element bears are provided on the side of the flange facing the resistive element. FIGS. 2 and 3 show an example of these raised portions. Radially directed strip-shaped raised portions 9 are provided on the end face of the flange 7, for example, by means of a pressing operation. The height of the strips 9 gradually increases from approximately the centre of the flange 7 towards the edge so that the highest parts are at the areas 10. The resistive element 1 only bears against these high areas 10. The heat dissipation to the conductor 3 will consequently be very small, which is of essential importance to obtain a short switching time of the resistor having a positive temperature coefficient.

FIG. 3 shows four raised portions 9. It will be clear that a different number of raised portions may be used and that the smallest number is three. It will also be evident that the shape of the raised portions may be different from the shape shown in FIGS. 2 and 3.

The conductor 4 is in contact with the resistive element 1 via a resilient element 8. As shown in FIG. 1 the resilient band 8 is relatively thin so as to impede heat dissipation from the resistive element 1. In order to obtain an even higher thermal resistance the width of the resilient band is less than half the diameter of the resistive element 1, as is shown in FIG. 5. The pressure exerted on the resistive element by the resilient element 8 is then still sufficiently large.

Figure 4:
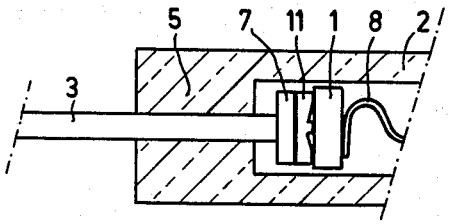
FIG. 4 shows a part of the resistor in which an extra heat shielding plate is shown.

FIG. 4 shows a part of another resistor in which a disk 11 of an electrically conductive material having a relatively low thermal conductivity is provided between the flange 7 and the resistive element 1. The disk 11 may be made of, for example, a nickel-iron alloy. On the side of the disk 11 facing the resistive element 1, raised portions are again provided. The low thermal conductivity of the disk forms an extra barrier for the flowing away of thermal energy from the resistive element 1. In addition, raised portions of a small area could also be provided on one of the two facing surfaces of flange 7 and disk 11 so as to reduce still further the thermal dissipation to the conductor 3.

For further reduction of the switching time the electric conductors 3 and 4 may be themselves manufactured from a material having a relatively low thermal conductivity. For example, a nickel-iron alloy may be chosen for the material of the conductors. Addition of a few percent of chromium may further increase the thermal resistance. The disk-shaped resistive element may alternatively have a trapezoidal cross-section, as a result of which the heat dissipation by radiation to the glass envelope is reduced and the switching time is shortened.

What is claimed is:

1. A positive temperature coefficient resistor comprising a generally tubular envelope, a plate-shaped resistance element having a positive temperature coefficient positioned within said envelope with the rotational axis thereof substantially parallel to the major axis of said envelope, two electrical conductors, each of said conductors making electrical contact with a separate major surface of said resistance element and each of said conductors extending out of an opposite end of said envelope, characterized in that at least one of said conductors has an end face opposed, and substantially parallel to a major surface of said resistance element and provided with outwardly extending portions bearing on, and forming an electrical contact with, a portion of the opposing major surface of said resistance element, said outwardly extending portions being radial strips whose height increases gradually from the center towards the end of the end face of said conductor.

2. A positive temperature coefficient resistor comprising a generally tubular envelope, a plate-shaped resistance element having a positive temperature coefficient positioned within said envelope with the rotational axis thereof substantially parallel to the major axis of said envelope, two electrical conductors, each of said conductors making electrical contact with a separate major surface of said resistive element and each of said conductors extending out of an opposite end of said envelope, characterized in that at least one of said conductors has an end face opposed, and substantially parallel to a major surface of said resistive element and provided with outwardly extending portions bearing on, and forming an electrical contact with, a portion of the opposing major surface of said resistive element, said outwardly extending portions being provided on a metal plate having a relatively low thermal conductivity and connected to the end face of said conductor.

3. A resistor having a positive temperature coefficient as claimed in claim 2 characterized that the material of the electric conductors is a nickel-iron alloy.

4. A resistor having a positive temperature coefficient as claimed in claim 1, characterized in that the outwardly extending portions are provided on a flange present at the end face of the conductor.

5. A resistor having a positive temperature coefficient as claimed in claim 1, characterized in that the material of the electric conductors is a nickel-iron alloy.

6. A resistor having a positive temperature coefficient as claimed in claim 1 in which one of the electric conductors has a resilient band which presses against the major surface of the resistive element facing said conductor, characterized in that the resilient band has a width which is smaller than half the diameter of the plate-shaped resistive element.

* * * * *